US007503788B2

(12) United States Patent
Holterhoff et al.

(10) Patent No.: US 7,503,788 B2
(45) Date of Patent: Mar. 17, 2009

(54) ELECTRICAL PLUG-IN CONNECTOR

(75) Inventors: Klaus Holterhoff, Olpe (DE); Thomas Salomon, Gütersloh (DE); Dennis C. Mackey, Hamilton, MA (US)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/999,666

(22) Filed: Dec. 6, 2007

(65) Prior Publication Data

US 2008/0214040 A1 Sep. 4, 2008

(51) Int. Cl.
*H01R 4/38* (2006.01)

(52) U.S. Cl. ..... 439/256; 439/354

(58) Field of Classification Search ..... 439/354, 439/357, 352, 312, 256, 257
See application file for complete search history.

(56) References Cited

U.S. PATENT DOCUMENTS 4,941,846 A * 7/1990 Guimond et al. ..... 439/578
5,931,695 A 8/1999 Scully
7,059,891 B2 6/2006 Bury
7,207,824 B1 4/2007 Schumacher
7,364,450 B2 * 4/2008 Hafner et al. ..... 439/255
2008/0207031 A1 * 8/2008 Chen et al. ..... 439/256

FOREIGN PATENT DOCUMENTS

DE 44 41 274 C1 10/1995
DE 102 33 075 A1 2/2004
EP 1 289 073 A1 3/2003

* cited by examiner

*Primary Examiner*—Neil Abrams
*Assistant Examiner*—Phuong Nguyen
(74) *Attorney, Agent, or Firm*—Lawrence E. Laubscher, Sr.; Lawrence E. Laubscher, Jr.

(57) ABSTRACT

A quick-fastening plug and socket arrangement includes a locking sleeve arranged concentrically between the plug and the circular socket opening within which the plug is axially inserted, which locking sleeve includes a resilient projection that is radially biased outwardly into locking engagement with screw threads carried by the inner circumferential surface of the socket opening. Alternatively, the projecting portion is biased radially inwardly for locking engagement with screw threads carried by the outer circumferential surface of the plug member. The sleeve is connected against longitudinal displacement relative to one of the plug and socket members, which sleeve is rotatable relative to the associated plug and socket member, thereby to release the plug for removal from the socket opening.

17 Claims, 8 Drawing Sheets

ELECTRICAL PLUG-IN CONNECTOR

BACKGROUND OF THE INVENTION

1. Field of the Invention

A quick-fastening plug and socket arrangement includes a locking sleeve arranged concentrically between the plug and the circular socket opening within which the plug is axially inserted, which locking sleeve includes a resilient projection that is radially biased outwardly into locking engagement with screw threads carried by the inner circumferential surface of the socket opening. The locking sleeve is connected against longitudinal displacement relative to an associated one of the plug and socket members, said sleeve being rotatable relative to the associated plug and socket member, thereby to release the plug for removal from the socket opening.

2. Description of Related Art

It is well known in the patented prior art to provide various plug and socket arrangements, as evidenced, for example, by the prior U.S. patents to Bury U.S. Pat. No. 7,059,891 and Schumacher et al U.S. Pat. No. 7,207,824, among others.

Many different embodiments are known for electrical plug connections of this kind. On the one hand, cables, equipped with the corresponding structural parts, can be connected with each other via such a plug connection; likewise, depending upon the design, several connections can be connected to a distributor with one plug part which distributor, in turn, is equipped with a plurality of socket counterparts to the plug parts.

The plug connections under discussion here permit a secure connection in the area of the connection points because the plug member, on the one hand, and the socket member, on the other hand, are secured via a thread-like connection with each other. In the simplest case, the plug members are equipped with a sleeve that has an outer projection that defines a so-called thread. Such designs make it necessary, after the plug contacts have been brought together, to produce a screw connection over the entire thread length. This implies by no means inconsiderable time expenditure, especially when one makes a plurality of such plug connections. Connections on distributors used in automation technology are often arranged relatively closely to each other, something that also adds to the time expenditure and makes the connection operation relatively laborious.

Therefore, plug members and corresponding socket members have been proposed which facilitate the insertion of the sleeve, on the plug side, into the socket member by simply pushing it in and, at the end of the assembly procedure, by means of a slight turn, permitting a final and axial retention between the two structural parts. But there is one disadvantage here: Designs used in the past necessitate expensive production and processing both of the sleeve of the plug part as well processing of the socket member, since currently known designs are based on the idea that [they] contain either bayonet-like connection possibilities or that both the sleeve of the plug part as well as the socket member are provided with unthreaded areas that extend in the axial direction, which facilitate an axial assembly or plugging-in, without any need for a turn and which only at the very last moment permit axial retention by turning. In the latter variant, a connection is made to an interior thread which is not provided with the axially free areas; in that case, one can furthermore not save any time when compared to the known screw connections.

SUMMARY OF THE INVENTION

Accordingly, a primary object of the present invention is to provide a quick-connect plug and socket arrangement including a locking sleeve arranged concentrically between the plug and socket members, said locking sleeve carrying resiliently biased projection portions that engage screw thread means provided on the adjacent circumferential surface of either the plug or the socket member, thereby to permit linear axial insertion of the plug into the socket, while locking the plug against axial removal from the socket opening. In the preferred embodiment, the screw thread means are provided on the inner circumferential surface of the socket opening, and the projections are biased radially outwardly from the locking sleeve. In an alternative embodiment, the screw thread means are provided on the outer circumferential surface of the plug, and the projecting portions a biased radially inwardly from the locking sleeve. In either case, the locking sleeve is connected against longitudinal displacement relative to the associated plug or socket member.

According to a more specific object of the present invention, the tubular locking sleeve is formed by punching and bending from a resilient metal sheet. A plurality of circumferentially-spaced locking projecting portions are formed by stamping the blank with U-shaped openings that define integral tongue portions that carry the projections at their free extremities. In one embodiment, the tongue portions are biased radially outwardly for engagement with the screw threads on the socket opening circumferential wall surface. In a second embodiment, the tongue portions are biased radially inwardly to effect engagement between inwardly projections on the tongue portion and screw thread means on the outer circumferential surface of the plug member.

The present invention was developed to provide a plug connection including plug and socket members such that one can bring about a particularly simple and fast connection with low production costs. The invention first of all provides an electrical plug connection with a plug member provided with a rotatable sleeve, for connection with a socket member that has an interior thread, whereby the sleeve, on its outer circumferential area, that engages the socket member, is provided with at least one deflectable, preferably resiliently deflectable projection that is fashioned in the manner of a part of an external thread turn.

As an alternative, in its internal circumferential area which receives the sleeve, the socket member is equipped with at least one deflectable, preferably elastically deflectable projection that is fashioned in the manner of an interior thread turn. Here, the sleeve is provided with an outer thread for connection with the socket member.

The present invention accordingly also creates a plug member for an electrical plug connection of the kind according to the invention, where the sleeve, on its outer circumferential area, engaging the socket member, is equipped with at least one deflectable, preferably resiliently deflectable projection fashioned in the manner of a part of an outer thread turn, as well as a socket part or socket member that, in its internal circumferential area that receives the sleeve, is equipped with at least one resiliently deflectable projection fashioned in the form of a part of the interior thread turn.

The terms plug member and socket member here relate not only to the electrical contacts, but especially to the screw connection with outer thread (plug part) and interior thread (socket part).

According to a preferred embodiment, the invention thus creates a plug member with a locking sleeve that can be made in a simple and inexpensive manner, for the fast and uncomplicated connection with a socket member, whereby the socket member can comply with the general industrial standard (for instance, according to the "M" standard, for instance, "M12" or "M8", or the like). In this case, the socket member is in the known manner provided with an interior thread. This embodiment is particularly preferred.

Similar advantages can be achieved when the socket member has a sleeve provided with projections and thus does not have a customary interior thread. In this case, the plug part is provided with an outer thread in the known manner.

The plug member of the present invention, with the shaped sleeve, can, in the axial direction, without any problem, be pushed into a socket member provided with an interior thread, because the projection or the projections can overcome the thread turns of the interior thread by virtue of their resilient capacity, but, at the same time, in each plug insertion state, become locked in a thread turn of the interior thread. After the sleeve has been pushed in axially, the sleeve can still be turned slightly in the way of a screw connection in order to fix a final assembly position. The turn required for this purpose is comparatively minor so that corresponding plug connections can be assembled extremely quickly and securely, specifically, also in poorly accessible installation situations and in case of a relatively tight arrangement of the connections.

The sleeve can be made easily and cheaply, because the only important thing here is to mold upon the sleeve at least one projection that forms a part of an outer thread turn. The elastic elements furthermore create a permanent vibration safety.

A development of the basic idea behind the invention, which can also be considered as an independent invention of its own, provides that the sleeve is made as a punch-bending part consisting of sheet metal. This offers the advantage that the locking sleeve need not have to be made as expensive turning part or by means of forming or casting; instead, it can be made by means of simple punching and bending procedures. It is furthermore possible, in this way, to apply this sleeve also upon the actual interior parts as part of a second production step so that these interior parts need not have to be extrusion coated.

Other production methods are conceivable, for instance, an embodiment as a synthetic plastic composite part or production from a type or design as a solid synthetic plastic part.

The plug member can also be installed fixedly on a housing, for example, a housing of a distributor. In this case, the socket member is mounted upon the fixedly installed plug part, which socket member can have a conventional interior thread. All of the above advantages are also implemented in this particular modification.

According to another advantageous modification, one can also reduce the time required for undoing the connection when compared to known connections, specifically, when the projections are not so arranged on the plug part or socket part that they engage the thread turn of the corresponding thread which is last in the axial plug-in directions, but instead, engage one of the first thread turns in the axial plug-in direction, for example, they engage in one of the first four, in particular, the second thread turn, because now one needs only a number of thread turns that would correspond to the number of rotation motions needed for separation. The plug part or socket part can be designed for assembly upon a housing or for connection to a cable.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
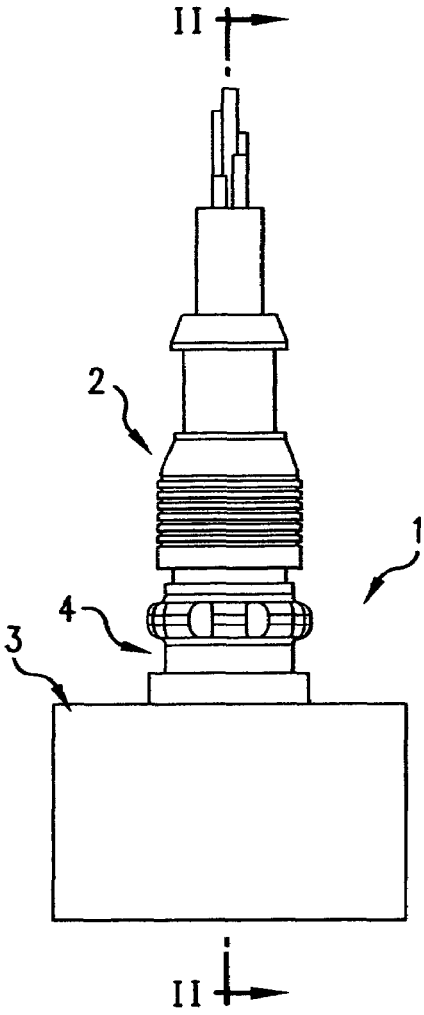
FIG. 1 is a an elevation view or the quick-fastening plug and socket arrangement of the present invention.
Figure 2:
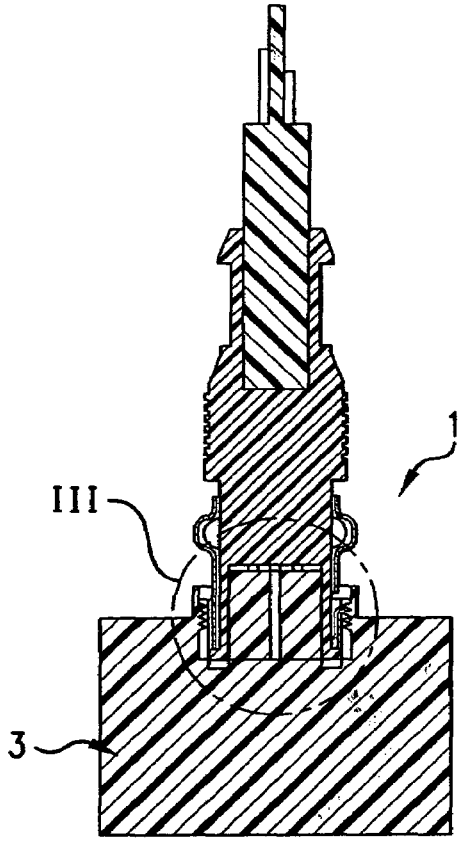
FIG. 2 is a sectional view taken along line II-II of FIG. 1.
Figure 3:
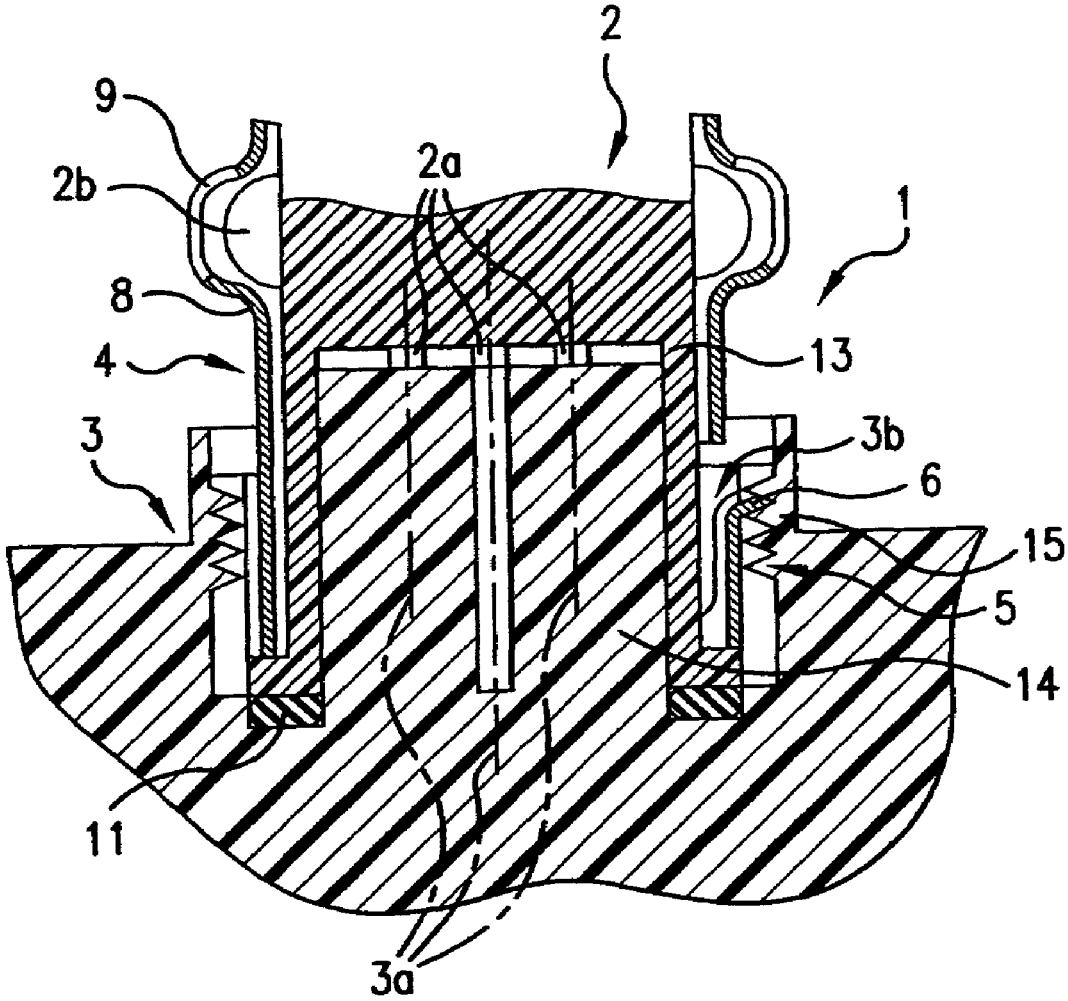
FIG. 3 is a detained view of the circled portion III of FIG. 2.

In FIGS. 1 to 3, the reference symbol 1 generally designates a plug connection arrangement which comprises a plug member 2 and a socket member 3 which can be plugged together linearly in the axial direction, as oriented and guided by guide means 20 (FIG. 4). The plug and socket members are equipped with corresponding first and second contacts 2*a*, 3*a* that in this case are made as pins 2*a* and corresponding sockets 3*a*. Plug member 2 has a cylindrical interior body 13 preferably consisting of an electrically-insulating synthetic plastic material, with the first contacts 2*a*, and the socket member 3 also has an interior body 14 consisting of electrically-insulating synthetic plastic material, with the second contacts 3*a*, whereby, in this case, the interior body of the socket 3 can be plugged, in its axial terminal area, into the internal body of plug member 2.

The plug member is equipped with a concentrically mounted locking sleeve 4 that is connected against longitudinal displacement relative to the plug member 2 by radially outwardly directed integral projections 2*b* that extend within an annular bulge portion on the sleeve externally of the socket member. The sleeve is connected for rotation with respect to the interior plug area 3*b*, which sleeve serves to establish a connection between plug member 2 and socket member 3. For this purpose, socket member 3, in the area of an outer sleeve portion 15, is provided on its inner circumferential surface with an interior thread 5 (FIG. 3), and sleeve 4 in its outer circumferential area adjacent the socket member 3 is provided with at least one radially outwardly elastically deflectable or resilient projection 6 that engages part of an outer thread turn, whereby this projection 6 or several such projections 6 are supported to engage one thread turn of the interior thread 5 of the socket member 3. This situation is illustrated clearly in FIG. 3.

Figure 4A:
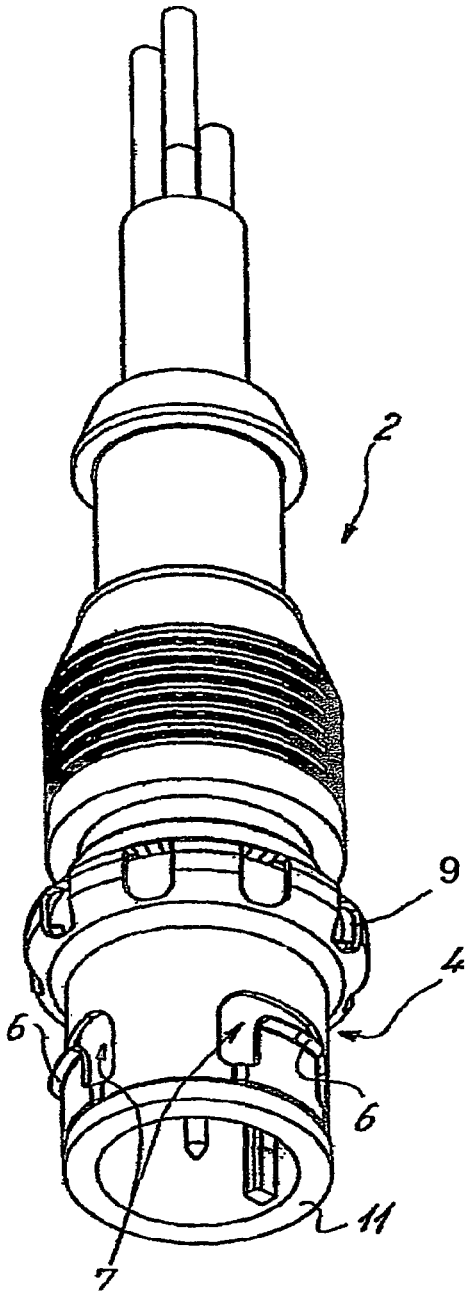
FIGS. 4*a* and 4*b* are bottom and top perspective views of the plug member of FIG. 1 with the locking sleeve mounted thereon.
Figure 4B:
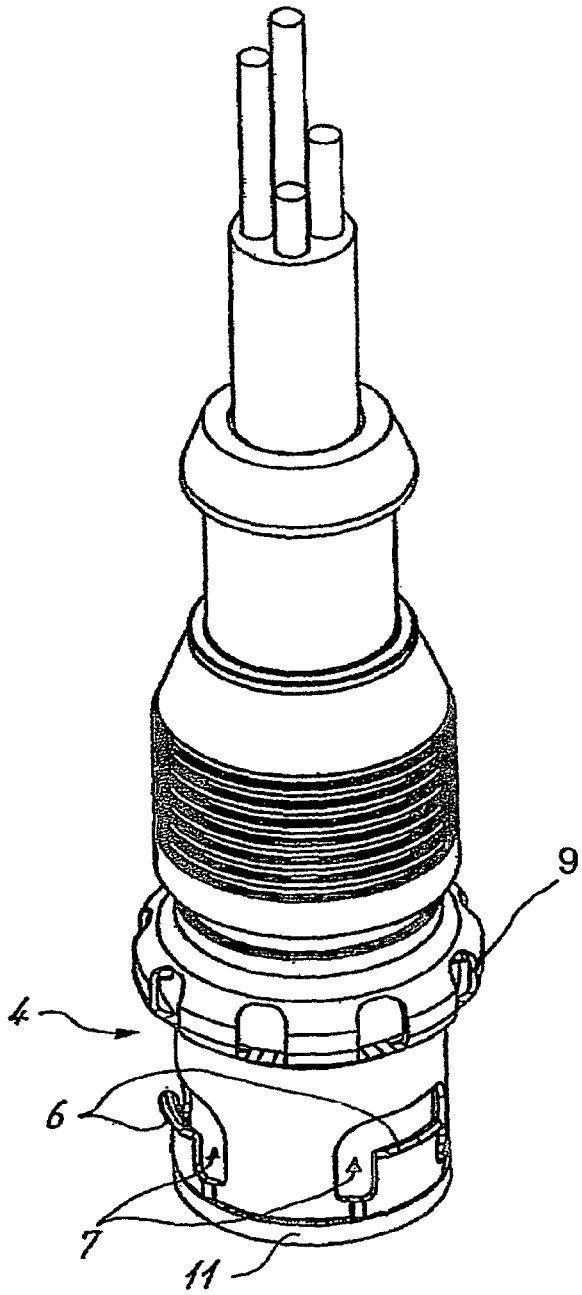
Figure 5:
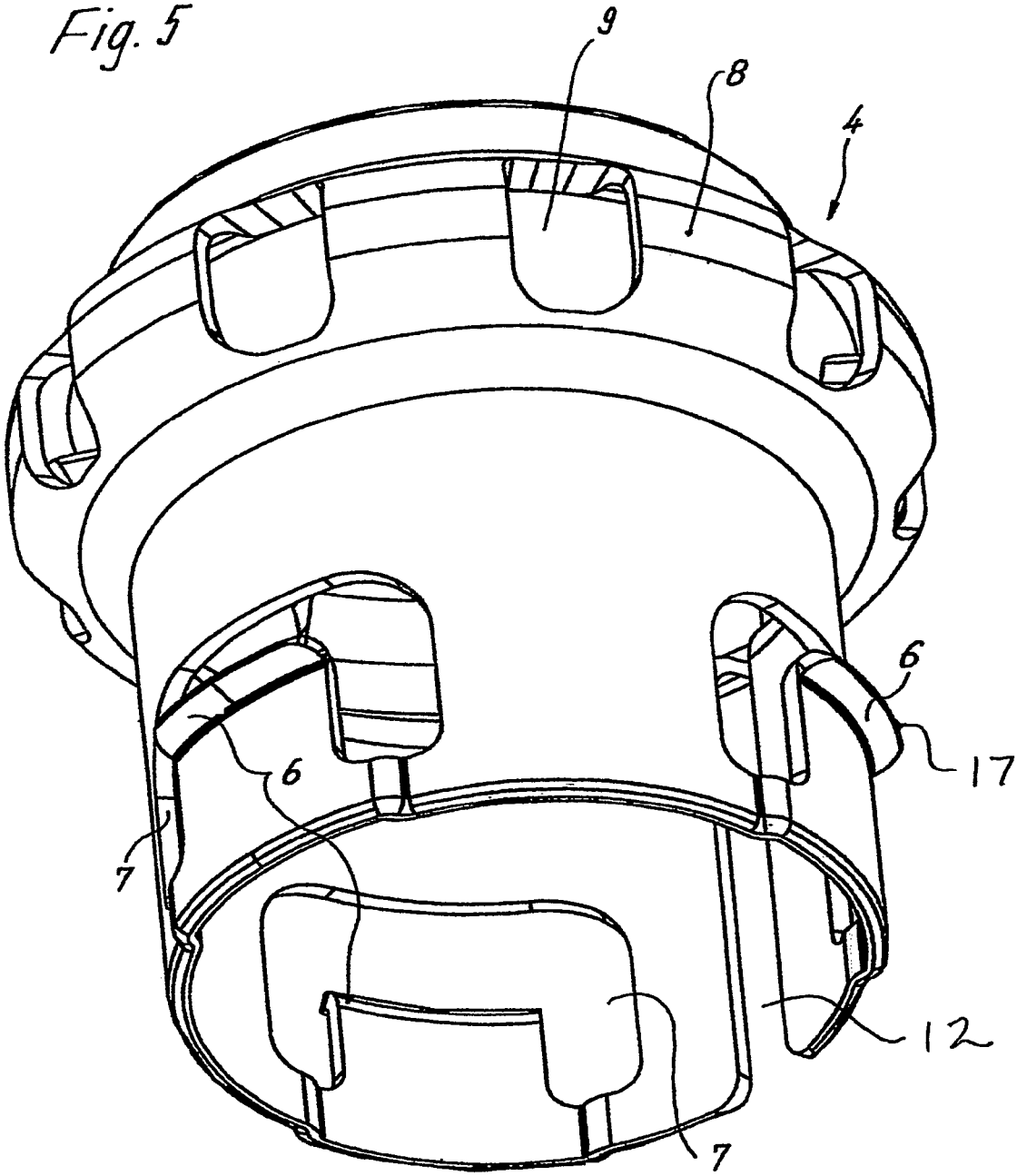
FIG. 5 is a bottom perspective view of the locking sleeve of FIGS. 4*a* and 4*b;*

As one can clearly see in FIGS. 4*a*, 4*b* and 5, locking sleeve 4 is provided in its outer circumferential area engaging the socket member 3 with a total of three projections 6. These projections 6 in each case form parts of a thread turn and, in the exemplary embodiment illustrated, are arranged in a manner staggered by about 120° with respect to each other. Besides, these projections 6 lie on a line of a thread turn whereby here naturally as an alternative it would also be possible to arrange the projections 6 as being staggered and offset relative to each other in the axial direction of sleeve 4, whereby the projecting portions engage different threads of the screw thread means 5. These figures furthermore make it clear that the projections 6 in each case at formed at the extremities of resilient tongue portions 6*a* defined in the locking sleeve by stamped U-shaped cut-outs 7, so that the resiliency of these projections 6 is guaranteed without any obstacle. Projections 6 are so oriented and are so inserted, in the plug-in direction, radially from the inside to the outside, that the plug part can be quickly pushed into the interior thread 5 of the socket member 3, whereby projections 6 are bent inwardly, whereas, on the other hand, in the opposite direction—in other words, during drawing—they block or lock, so that, for purposes of separation, they have to be turned so that they can be released. A terminal edge 17 of projection 6 is so bent outward that it, in a defined manner, engages an individual thread turn of the interior thread of the socket member. Except for projections 6, there is no outer thread present on the locking sleeve 4.

Additional projections, for example, those turned by 90° (not illustrated here), can also be used to make a kind of thread retention in the manner of additional springs, so that they will be blocked against becoming loosened as a result of turning 2 (not illustrated here).

In general, locking sleeve 4, in this case, in a preferred embodiment, is made advantageously as a punch-bending part consisting of resilient sheet metal, something that is particularly cheap and simple. In assembling the sheet metal strip, the latter need not be closed to form a complete tube, although this is conceivable; instead, a narrow slit 12 can be left also in the assembled state. Other embodiments are also conceivable, for example, they can be formed made from a piece of tubular stock.

Figure 6:
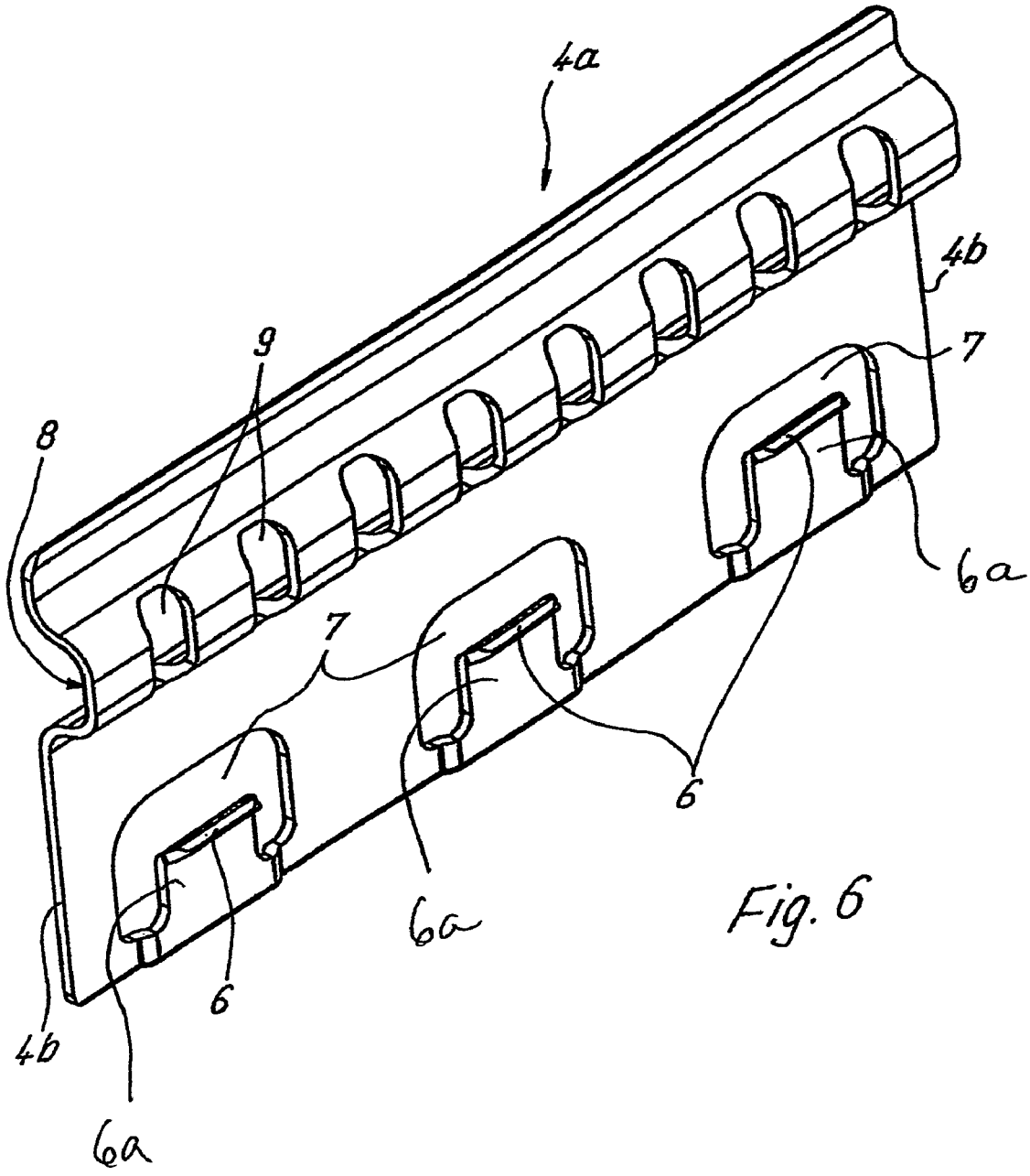
FIG. 6 is a perspective view illustrating the punched resilient sheet metal blank from which the locking sleeve is formed.
Figure 7:
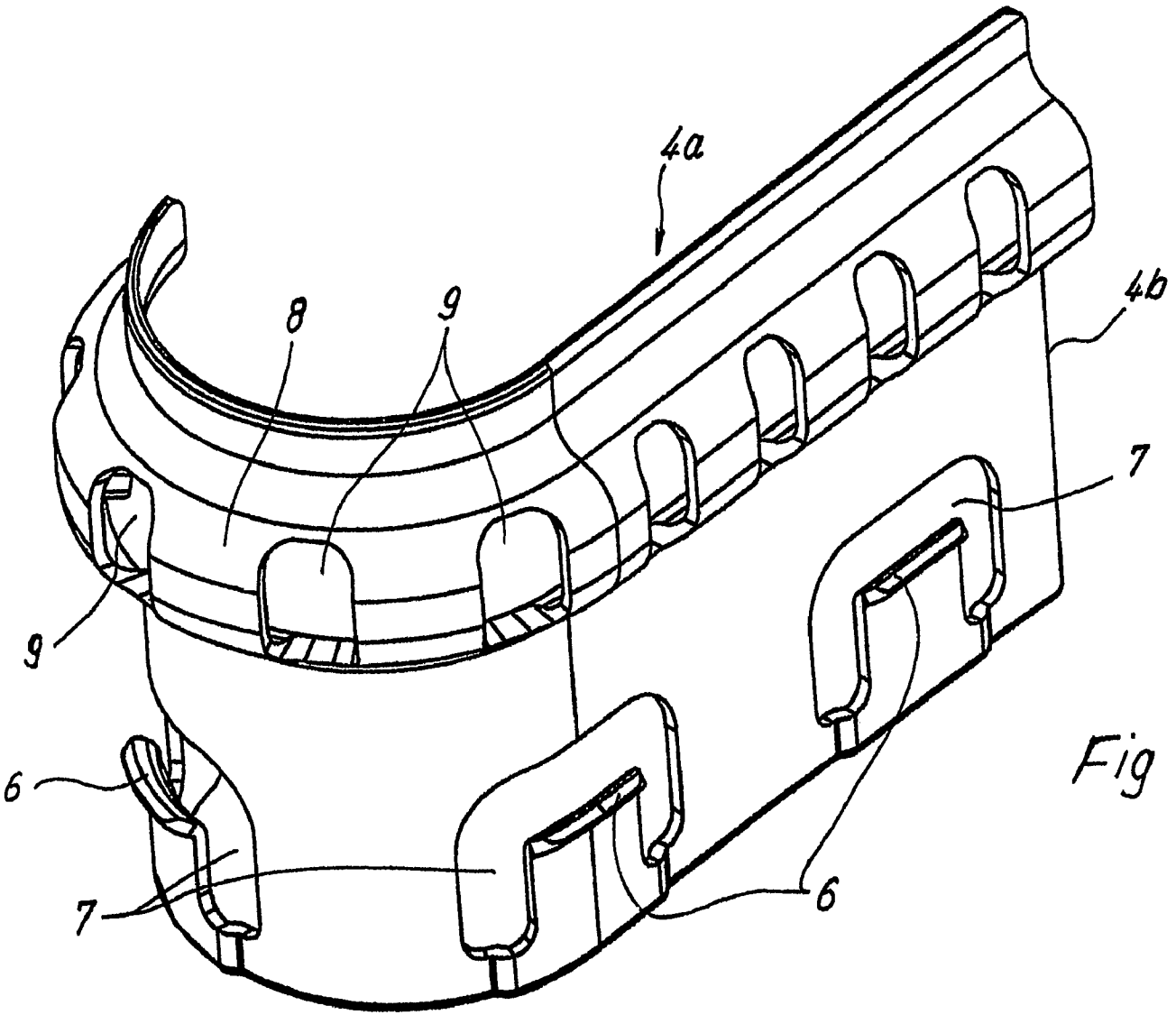
FIG. 7 illustrates the manner of bending the sheet metal blank of FIG. 6 to form the tubular slit sleeve.

FIGS. 6 and 7 show a blank which initially still lies flat and which in FIG. 7 is already partly bent into a cylindrical form, for the production of a corresponding sleeve 4. The blank is labeled 4*a* in FIGS. 6 and 7. Here we can clearly see again the projections 6 and the U-shaped stampings 7, within which lie the projections 6. Besides, FIGS. 6 and 7 clearly show that the particular blank, on its side facing away from the projections 6, is provided with an upper front edge with an annular molded-on bulge 8 portion containing circumferentially spaced penetration openings 9. As a result, sleeve 4 is also made with a bulge 8 and with the penetration openings 9, which make it easier to put on a tool for the purpose of rotating the sleeve to permit separation of the plug from the socket. Naturally, if necessary, sleeve 4 can also be tightened manually into a secured position or can again be separated if disassembly should become necessary.

Sleeve 4, made as punch-bend part, can, after its production, be fashioned as a closed sleeve by connecting its two blank ends 4*b*, while it is also possible to have the two blank ends 4*b* not abut quite against each other so that sleeve 4 remains axially open to define a slit 12 that extends the length of the sleeve. The latter to that extent is not a disadvantage since the sleeve, in the connected state, engages the interior thread 5 of a socket member 3 anyway.

Figure 8:
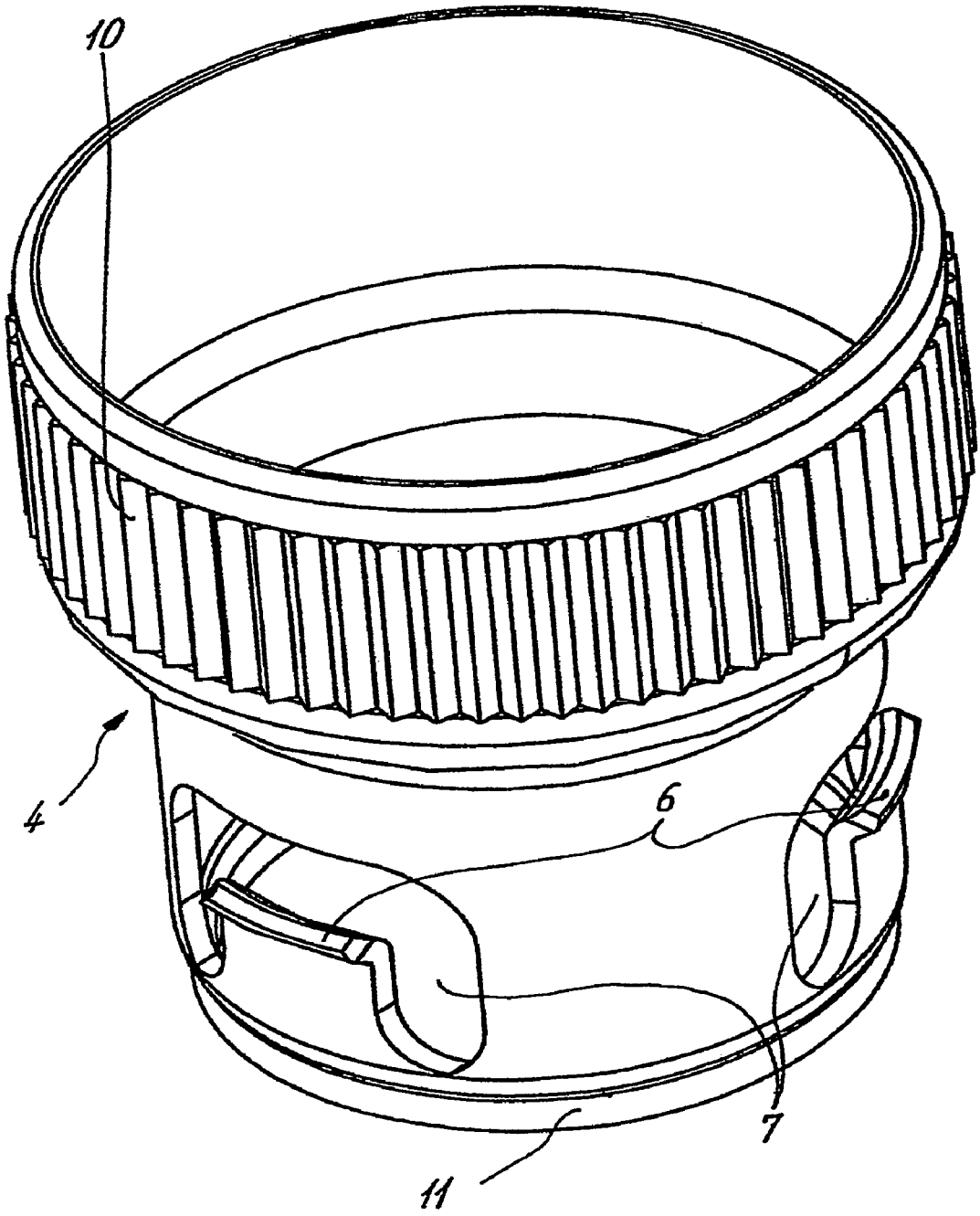
FIG. 8 is a perspective view of another embodiment of the locking sleeve.

FIG. 8 shows a variation of the sleeve wherein, instead of being provided with a bulge 8, the sleeve 4 is provided with a knurled end portion 10, by means of which handling of the sleeve is made easier when screwing tightly or when separating a connection. This modification, for example, can be made by shaping from a piece of tubular stock. It does not have an axial slit 12. Separating tools of the same type can be placed both upon the bulge and also upon the knurling (in the manner of a wrench). Manual separation is also possible.

As shown in FIGS. 4*a*, 4*b* and 8, the locking sleeve 4, regardless of its usual design, on its front terminal area, that is associated with projections 6, engages the socket member 3 which is equipped with a compressible annular seal 11 that rests against the sleeve 4 in the assembled state, as one can clearly see in FIG. 3.

Plug part 2 with sleeve 4 can without any problem be pushed linearly (as guided by orientation means 20 (FIG. 4*a*) in the axial direction into the socket member 3 which is provided with the interior thread. After the sleeve has been pushed in axially, it can still be turned slightly in terms of a screw connection in order to fix a final assembly position. The connection is separated in the known manner by simply screwing it loose in the opposite direction.

Figure 9:
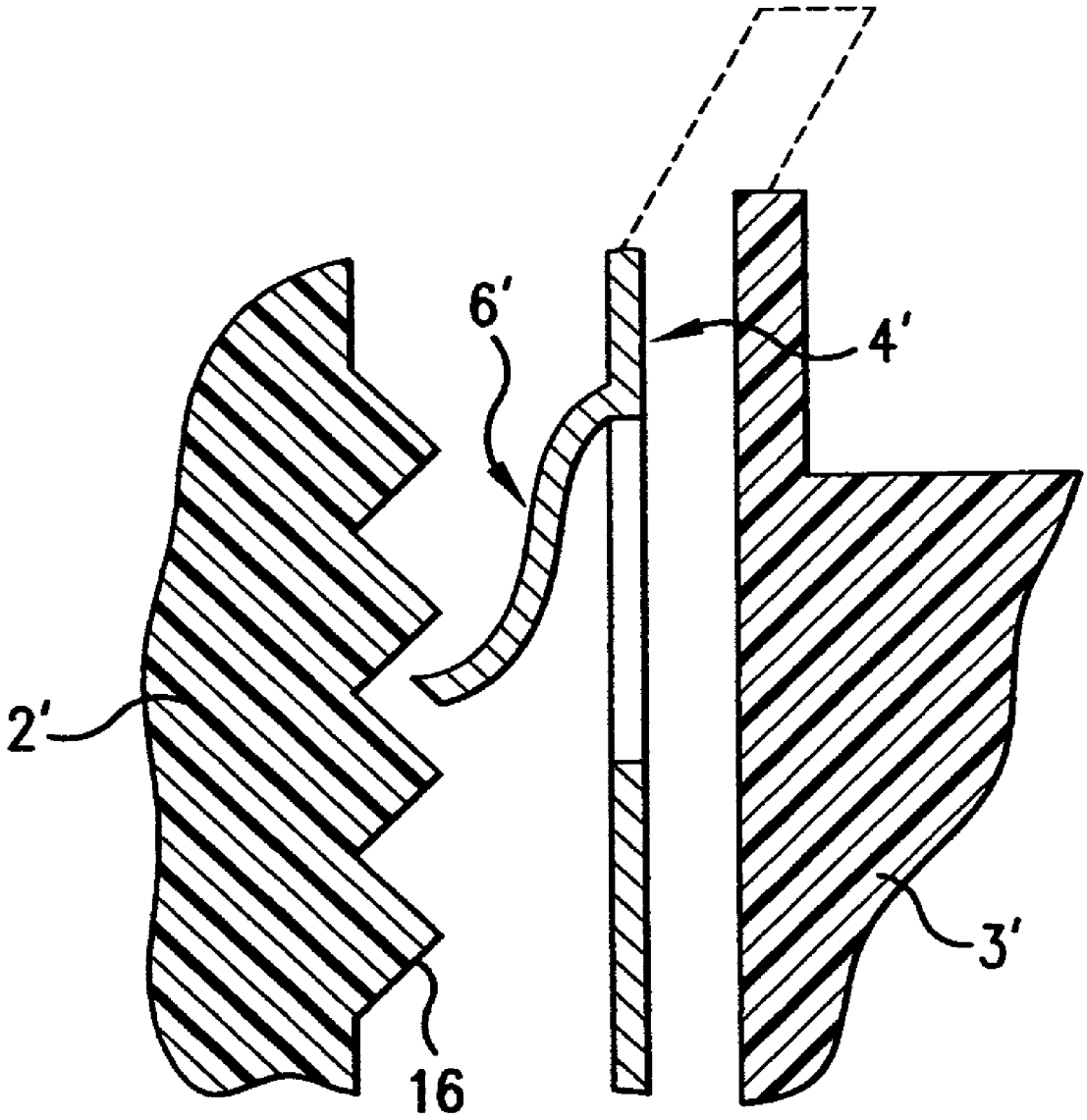
FIG. 9 is a detailed sectional view of a second embodiment of the present invention.

FIG. 9 is a diagram showing an alternate embodiment of the invention; wherein the plug member 2 (indicated in the diagram only in terms of segments) is fashioned according to the industrial standard and has an outer thread 16 whereas, in this case, the socket member 3 is provided with a locking sleeve 4' having a resilient projection 6' which effectively serves in the manner of an internal thread turn segment. When the socket member is pushed linearly axially toward the plug member 2', the projection 6' is deflected outwardly, and when the plug reaches its final inserted position, the projection 6' is biased radially inwardly toward engagement with a corresponding turn of the screw means 16 formed on the outer circumferential surface of the plug member 2'. In the assembled state, the resilient biasing force in the embodiment of FIG. 9 is directed radially inwardly, whereas, according to FIGS. 1 through 8, it works outward radially outwardly in the connected state. The sleeve is connected for rotation relative to the socket member, but is prevented from longitudinal displacement relative thereto.

While in accordance with the provisions of the Patent Statutes the preferred forms and embodiments of the invention have been illustrated and described, it will be apparent to those skilled in the art that changes may be made without deviating from the invention described above.

What is claimed is:

1. A quick-fastening plug and socket arrangement, comprising:

(a) a socket member (3) containing a circular opening (3*a*) having a cylindrical internal circumferential wall surface, said socket member being formed from an electrically-insulating synthetic plastic material and including a plurality of electrical socket contacts (3*a*) arranged in said opening;

(b) a plug member including a body portion formed from an electrically-insulating synthetic plastic material and including a first end having a cylindrical outer circumferential surface extending in concentrically spaced relation within said socket opening, said plug member having a plurality of electrical plug contacts in engagement with said socket contacts, respectively; and (c) locking means operable when said plug member is linearly inserted axially within said socket opening for fastening said plug member to said socket member, including:

(1) a tubular locking sleeve (4) arranged concentrically between said plug and socket circumferential surfaces, said locking sleeve being connected against longitudinal displacement relative to one of said plug and socket members;

(2) screw thread means (5; 16) arranged on the circumferential surface of the other of said plug and socket members;

(3) said locking sleeve having at least one integral resilient projecting portion (6; 6') biased radially into locking engagement with said screw thread means, thereby to prevent axial removal of said plug member from said socket opening.

2. A quick-fastening plug and socket arrangement as defined in claim 1, and further including guide means (20) guiding said plug member for axial displacement relative to said socket member.

3. A quick-fastening plug and socket arrangement as defined in claim 1, and further including an annular seal (11) arranged between the bottom wall of said socket opening and the adjacent end surface of said plug member.

4. A quick-fastening plug and socket arrangement as defined in claim 1, wherein said screw thread mean (16) are provided on said plug member outer circumferential surface.

5. A quick-fastening plug and socket arrangement as defined in claim 4, wherein said locking sleeve projecting portion (6') is biased radially inwardly toward locking engagement with said plug member screw thread means (16).

6. A quick-fastening plug and socket arrangement as defined in claim 1, wherein screw thread means (5) are provided on said socket member internal circumferential surface.

7. A quick-fastening plug and socket arrangement as defined in claim 6, wherein said locking sleeve projecting portion (6) is biased radially outwardly toward locking engagement with said socket member screw thread means (5).

8. A quick-fastening plug and socket arrangement as defined in claim 7, wherein said locking sleeve (4) comprises a punched and bent resilient metal sheet component.

9. A quick-fastening plug and socket arrangement as defined in claim 8, wherein said locking sleeve includes a plurality of circumferentially-spaced radially outwardly directed projecting portions (6) partially punched from the resilient metal sheet.

10. A quick-fastening plug and socket arrangement as defined in claim 9, wherein said projecting portions (6) are contained in a single line for engagement with a single turn of said socket screw thread means.

11. A quick-fastening plug and socket arrangement as defined in claim 9, wherein said projecting portions (6) are longitudinally staggered relative to said plug member for engagement with different turns of said screw thread means.

12. A quick-fastening plug and socket arrangement as defined in claim 9, wherein said locking sleeve is connected for rotation relative to said plug member; and further wherein said locking sleeve includes externally of said socket opening an outwardly directed annular bulging portion (8) spaced longitudinally from said projecting portions, said bulging portion containing a plurality of circumferentially spaced openings for receiving a rotating tool for rotating said sleeve relative to said plug and socket members, thereby to tighten or to loosen the connection between said plug and socket members.

13. A quick-fastening plug and socket arrangement as defined in claim 9, wherein said locking sleeve is connected for rotation relative to said plug member; and further wherein said locking sleeve includes externally of said socket opening a knurled annular end portion (10) for rotating said sleeve relative to said socket member and plug members, thereby to tighten or loosen the connection between said locking sleeve and said socket member.

14. A quick-fastening plug and socket arrangement as defined in claim 9, wherein said locking sleeve is tubular and continuous.

15. A quick-fastening plug and socket arrangement as defined in claim 9, wherein said locking sleeve contains a longitudinal slit (12) extending the length thereof.

16. A quick-fastening plug and socket arrangement as defined in claim 9, wherein each of said projections (6) is carried by and extends outwardly from the extremity of an integral tongue portion (**6*a*) defined in said locking sleeve by a generally U-shaped punched opening 7**, said tongue extending longitudinally toward the other end of said plug member and being resiliently biased radially outwardly relative to said sleeve member.

17. A quick-fastening plug and socket arrangement as defined in claim 16, wherein the length of said locking sleeve is such that when said plug is fully inserted into said socket, said projecting portion cooperates in locking engagement with the first turn of said socket screw means.

* * * * *

UNITED STATES PATENT AND TRADEMARK OFFICE

CERTIFICATE OF CORRECTION

PATENT NO. : 7,503,788 B2
APPLICATION NO. : 11/999666
DATED : March 17, 2009
INVENTOR(S) : Klaus Holterhoff, Thomas Salomon and Dennis C. Mackey It is certified that error appears in the above-identified patent and that said Letters Patent is hereby corrected as shown below:

Title Page; item (75);
In the Heading, the Assignees to be listed are:

Weidmuller Interface GmbH & Co. KG (50% interest)
Detmold, Germany

Rockwell Automation Technologies, Inc. (50% interest)
Mayfield Heights, Ohio 44124

Signed and Sealed this

Twenty-second Day of September, 2009

David J. Kappos

David J. Kappos
*Director of the United States Patent and Trademark Office*